US006086409A

United States Patent [19]

Patel et al.

[11] Patent Number: 6,086,409

[45] Date of Patent: Jul. 11, 2000

[54] CONNECTOR FOR FLAT-CONDUCTOR FLAT CABLES OR FLEXIBLE CIRCUITS

[75] Inventors: Punjabhai B. Patel, Moundsview; Ronald D. Natzel, Chaska, both of Minn.

[73] Assignee: Abe1Conn, LLC, New Hope, Minn.

[21] Appl. No.: 09/182,584

[22] Filed: Oct. 29, 1998

[51] Int. Cl.[7] ..... H01R 11/20

[52] U.S. Cl. ..... 439/422; 439/492

[58] Field of Search ..... 439/422, 492, 439/421, 423, 424, 417, 418, 442, 873, 546

[56] References Cited

U.S. PATENT DOCUMENTS 3,825,881 7/1974 Wigby ..... 439/422
5,077,893 1/1992 Mosquera et al. ..... 29/882
5,727,967 3/1998 Chen ..... 439/418
5,888,103 5/1999 Norizuki et al. ..... 439/701

*Primary Examiner*—Paula Bradley
*Assistant Examiner*—Ross Gushi
*Attorney, Agent, or Firm*—Schwegman, Lundberg, Woessner & Kluth, P.A.

[57] ABSTRACT

A flat-cable connector has a contact element formed from a single blank of flat conductive material. A flat body has jaws folded out of the plane of the blank. A pair of legs in the plane carry sharpened pegs on offsets out of the plane. A grooved connector shell has a flap that compresses the legs together in the plane so that the pegs in one leg slice through the cable and fold around the cable.

19 Claims, 3 Drawing Sheets

CONNECTOR FOR FLAT-CONDUCTOR FLAT CABLES OR FLEXIBLE CIRCUITS

BACKGROUND OF THE INVENTION

The present invention relates to electrical connectors, and more specifically concerns connectors for engaging multiconductor flat cables and connector elements and methods for making them.

Computers and many other kinds of electronics equipment rely heavily upon multiconductor cables for routing signals and power among various subassemblies and other units. Many of these take the form of flat cables having side-by-side conductors. Frequently, these cables also have flat conductors, and their covering is one or more thin layers of insulating material. In a number of applications, cables are merely extensions from flexible printed circuits. That is, the term "cable" must be taken in a broad sense as a sheathed group of mutually insulated electrical conductors. Because current and voltage levels are very low in many applications, flat cables frequently employ very small conductors and very thin insulators in order to achieve small size.

Small cables, however, require small connectors. Small connectors in turn require very small and very closely spaced contact elements for the individual conductors of the cable. One conventional configuration employs contacts spaced on 0.1 inch centers. The cable itself is capable of much closer spacing; 0.050-inch conductor spacing and even less is achievable. Connectors having two rows of contacts can render the connector not much wider than the cable. However, such connectors are relatively complex and expensive to manufacture. Often the pins that they connect to must use extra area on a circuit board for contact pins and wiring patterns, because modern printed circuit boards can easily place conductors 0.050 inches apart.

Merely reducing the size of conventional connector or contact elements is not straightforward. Smaller elements become difficult to manufacture and to handle. Their relatively complex designs require precision that leads to increased cost and wastage. Some elements have multiple pieces and must be assembled. Placing conventional elements into connector shells either by machine or by hand becomes increasingly difficult. Reliability, which is always a major problem in multiconductor connectors, suffers greatly.

Electronics manufacturers continue to request smaller and smaller multiconductor connectors for their equipment. At the present time, there is an unsatisfied demand for inexpensive, reliable flat cable connectors having contact spacings of 0.050 inch or less.

SUMMARY OF THE INVENTION

The present invention offers a connector that can accommodate contact spacings 0.050 inch and even less. The connector element design is simple, inexpensive, easily manufactured, and reliable.

A connector element according to the invention differs from previous designs in being made from flat sheet stock in such a way that the parts that engage a cable conductor do so by compression in the plane of the blank that forms the connector element. In effect, the present element is made sideways. Multiple elements are then stacked on top of each other in assembling a connector. A simple grooved shell spaces the stacked elements, and a top cover compresses all the element legs at once onto a multiconductor cable so that pegs or teeth in the elements contact the conductors. The element legs are optionally offset from the plane of their original blank in the region of the pegs, so as to provide a scissors effect when the pegs engage the cable conductors, and the pegs can actually fold over the conductors to clinch the cable in the manner of a staple.

DETAILED DESCRIPTION

The following description of an illustrative embodiment permits one skilled in the art to make and use preferred forms of the invention, when taken in conjunction with the accompanying drawing. Some variations are explicitly noted. Other modifications within the spirit of the invention, as well as further uses and advantages, will become apparent to those in the art. The scope of the invention is measured only by the appended claims.

Figure 1:
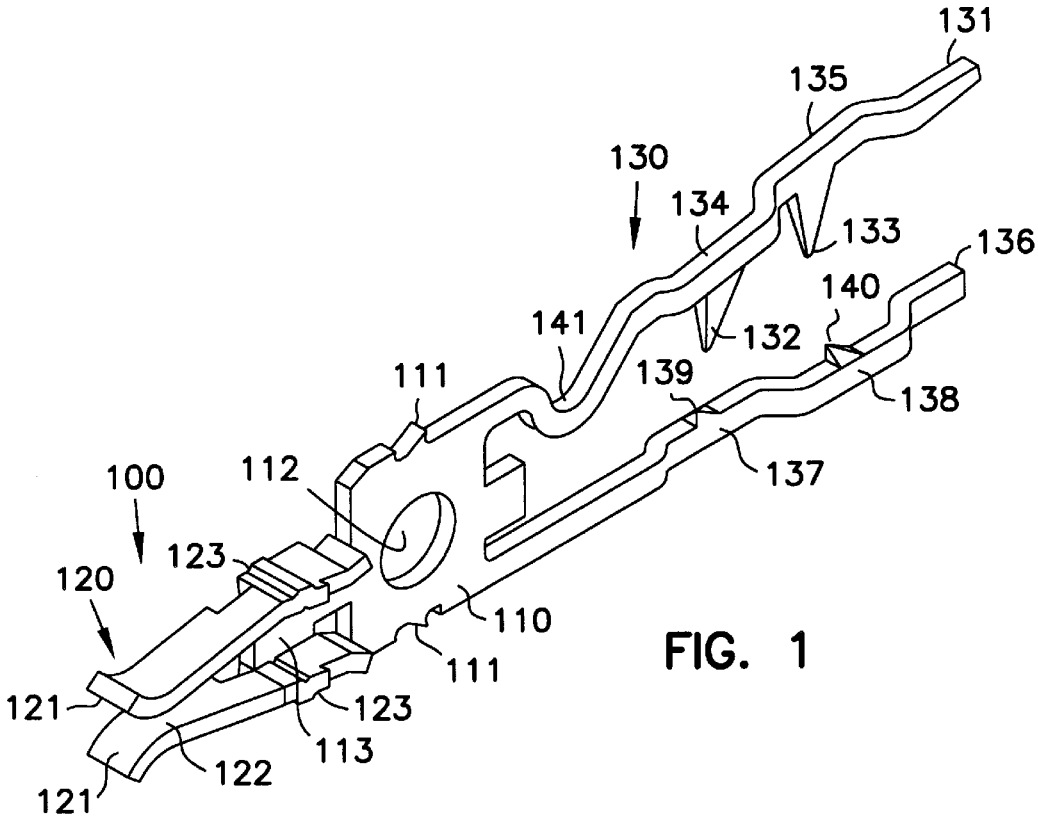
FIG. 1 is a perspective of a connector element according to the invention.

FIG. 1 shows a single connector element 100 in perspective. The element is integrally formed in a single piece from a flat blank whose plane is in the page of FIG. 1. Nevertheless, it is convenient to describe the direction from the top to the bottom of FIG. 1 as the vertical direction or height. Horizontal is the lengthwise direction of FIG. 1, from left to right. Width and thickness are perpendicular to the plane of the blank, and offsets refer to elevations or depressions above and below the plane of the blank.

Figure 2:
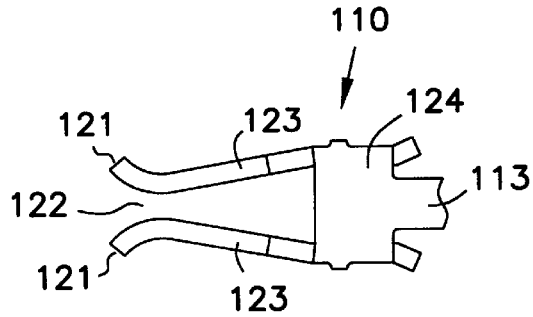
FIG. 2 is a partial side elevation of the element of FIG. 1.

Element 100 extends around a body 110. The body portion lies in the plane of the blank from which element 100 is formed. It includes one or more barbs for holding it in place in a connector shell as described below. Round hole 112 aids in manufacture. A thinner neck 113 carries two jaws 120 that are folded perpendicular to the plane of head 110. Both jaws are curved for receiving a square or round contact pin, not shown. A pin engages lips 121 and forces them apart as it slides into a narrower throat 122, to provide a spring contact. The rearward portions 123 widen so as to allow the pin to continue lengthwise into the element 100. FIG. 2 is a side view of the jaw portion 120, and more clearly shows the wider base 124 from which jaws 121 are folded away from the plane of neck 113.

Legs 130 extend rearwardly from body 110 and jaws 120, and diverge from each other somewhat—about 15° in this example. Although legs 130 operate in the vertical direction in FIG. 1, they actually lie in the same plane as does body 110, and their thickness is the same as body 110. In a typical application, their height is not much greater than their thickness, however, so that they are almost square in cross section. Upper leg 131 has a bow 141 to facilitate its movement in the vertical direction of FIG. 1 without breaking, and to provide some amount of spring tension when it is compressed downward. Pegs or teeth 132 and 133 project downwardly. They are sharpened to points, by having triangular shapes from front to rear, and/or by having decreasing thickness away from their points of attachment to leg 131. The pegs are placed on portions of leg 131 that are offset from the plane of the blank that forms the legs. That is, the portions bend away from the plane, then run substantially parallel to it for a distance.

One portion 134 is elevated or offset above this plane, while the other portion 135 is depressed or offset below the plane. The thickness of peg 132 decreases into the page of FIG. 1, while peg 133 thins out of the page. That is, they both thin toward the plane of body 110. This construction cancels any sideways force on a cable conductor when the pegs pierce its insulation and bite into the conductor. The lower leg 136 has two portions that are offset in the same manner, but in opposite directions. Portion 137 is offset below the plane, while portion 138 is offset above the plane. These portions carry smaller pegs or barbs 139 and 140 that also sharpen to a point. Although pegs 139 and 140 could also be designed to penetrate a cable, their height here is only sufficient to provide extra holding power on a cable to position it correctly and to prevent a backward force form dislodging it.

Figure 3:
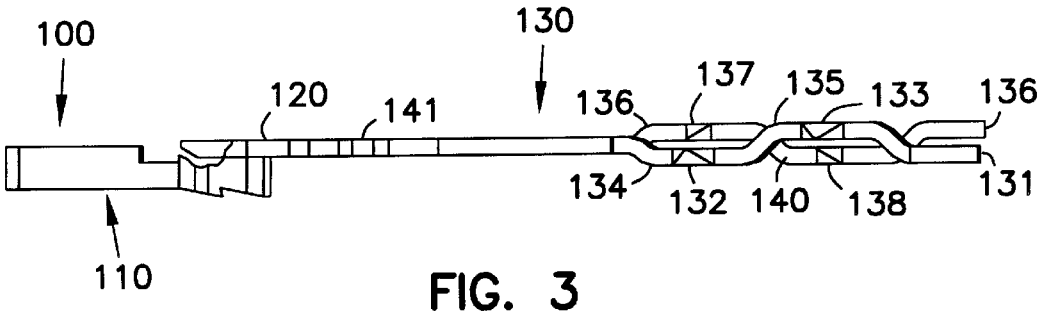
FIG. 3 is a top plan of the element of FIG. 1.

Offsetting portion of the legs and positioning the pegs on these offsets offers greater holding power, and thus greater reliability. FIG. 3 shows that the combined offsets of the two legs is about the same as or slightly greater than the thickness of the blank that forms element 100. The length of pegs 132 and 133 is enough that they slide along and past portions 137 and 138 of lower leg 136, to engender a slicing or scissors action as their sharp points cut through a cable. The offsets also position element 100 in a connector shell and prevent it from tilting, as described below.

Figure 4:
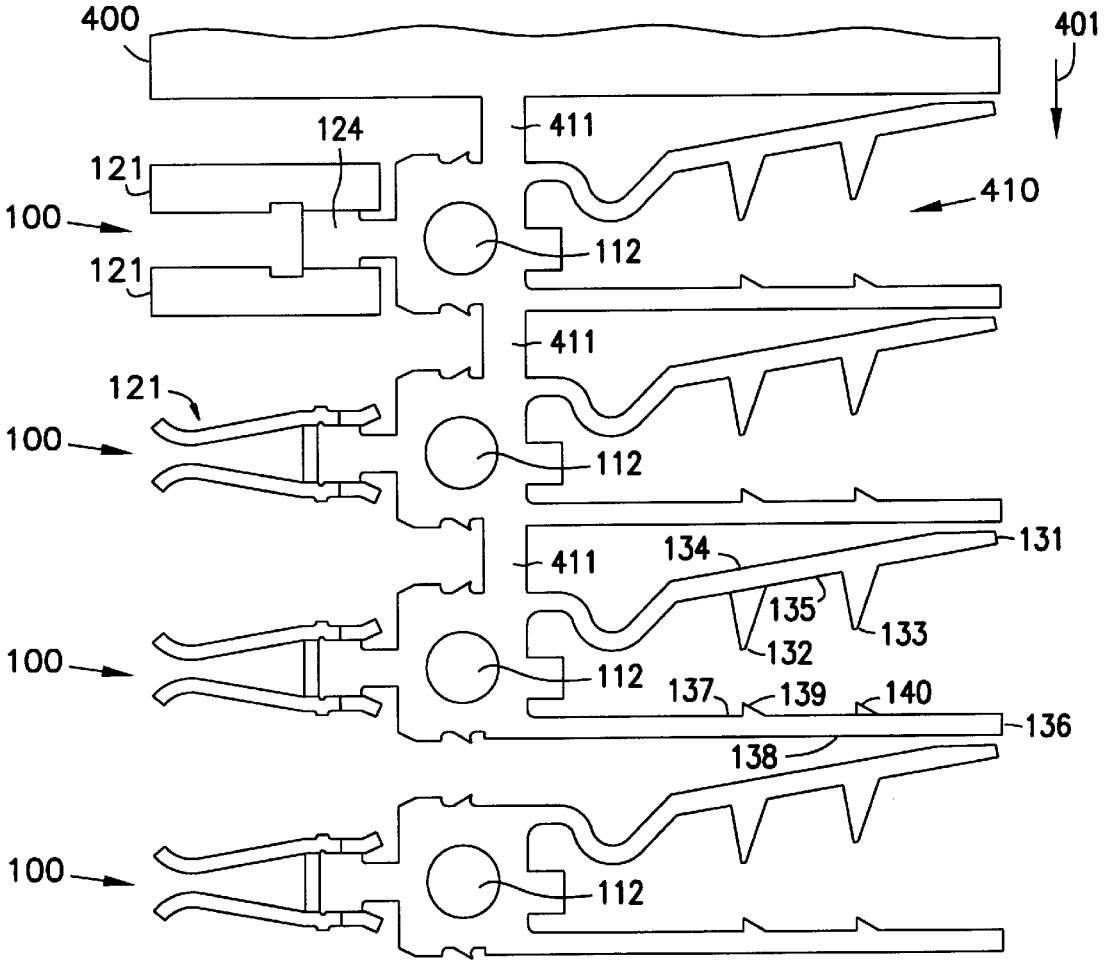
FIG. 4 shows the manufacture of elements according to FIG. 1.

FIG. 4 illustrates a manufacturing process for elements 100. A single strip of feedstock 400 passes through a progressive die (not shown) or similar conventional tool in the direction of arrow 401. For the illustrated example of a flat-cable connector having contacts on 0.050-inch or 0.039-inch centers, strip 400 can be about 0.010 inch thick. Materials for electrical contact elements include phosphor bronze, beryllium copper, brass alloys, and many others. Thickness and composition must be balanced among qualities such as strength, spring qualities, electrical conductivity, and corrosion resistance, as in conventional practice. A typical element length for these spacings is about 0.5 inch; that is, the carrier strip or blank 400 is about 0.5 inch wide.

One stage of the progressive die cuts the overall shape 410 from the carrier strip 400. Carrier strip 411 joins the element to the feedstock strip for pulling strip 400 through the die. At this point, all parts of element 100 lie in the plane of blank 400. In particular, jaws 121 are spread open about base 124 of neck 113. Hole 112 locates the element s at each stage of the die. Another stage folds and shapes jaws 121 away from the plane of the blank. Another stage coins the pegs 132, 133, 139, and 140, and also forms the offsets 134, 135, 138, and 138 into legs 131 and 136. A final stage separates the individual elements 100 apart by cutting carrier strip 411. The number, sequence, and specific operations of such dies varies greatly in conventional practice. For example, several different operations can occur at a single stage, but a single coining operation could require several stages to achieve a desired thickness reduction. The result is a single-piece element, and one that is built "sideways"—that is, where substantial movement of the parts that engage the cable occur in the plane of the original blank, rather than across the thickness of the strip that forms the contact element.

Figure 5:
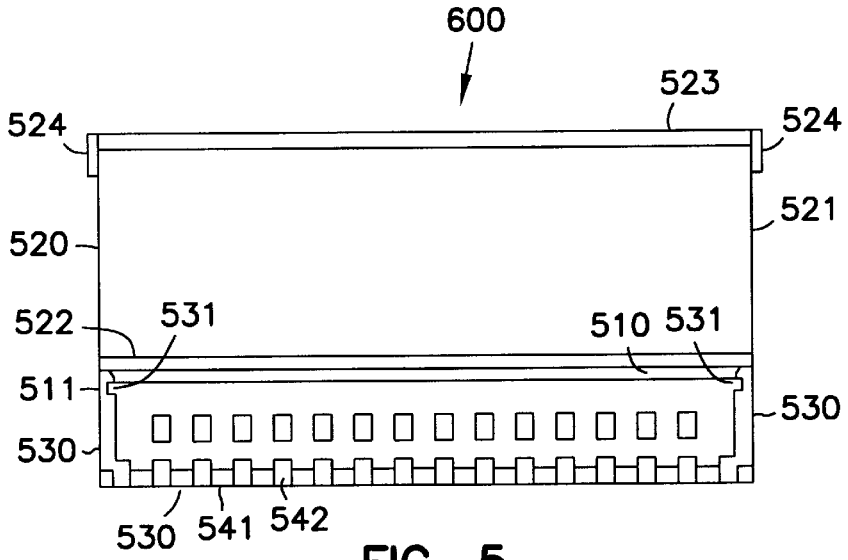
FIG. 5 is a rear view of a housing for a connector according to the invention.

FIG. 5 is a rear view of a connector shell 500 for holding a number of connector elements 100, such as 15 elements, in a single stack or row. Front face 510 has a number of apertures 511 for admitting contact pins from a printed-circuit board or other equipment. Top surface 520 includes a flap or cover 521 attached to the remainder of the top surface by a living hinge 522. The rear edge of flap 521 has a downwardly extending shoulder 523. Flap 521 also has a pair of locking tabs 524 at over at least a portion of its side edges. Side walls 530 of the shell have slots 531 that engage tabs 524 when flap 521 swings down to a closed position. Lower wall 540 has a series of formed grooves 541 separated by ridges 542. Each groove 541 is sized and shaped to accept a connector element 100 inserted from the rear.

Figure 6:
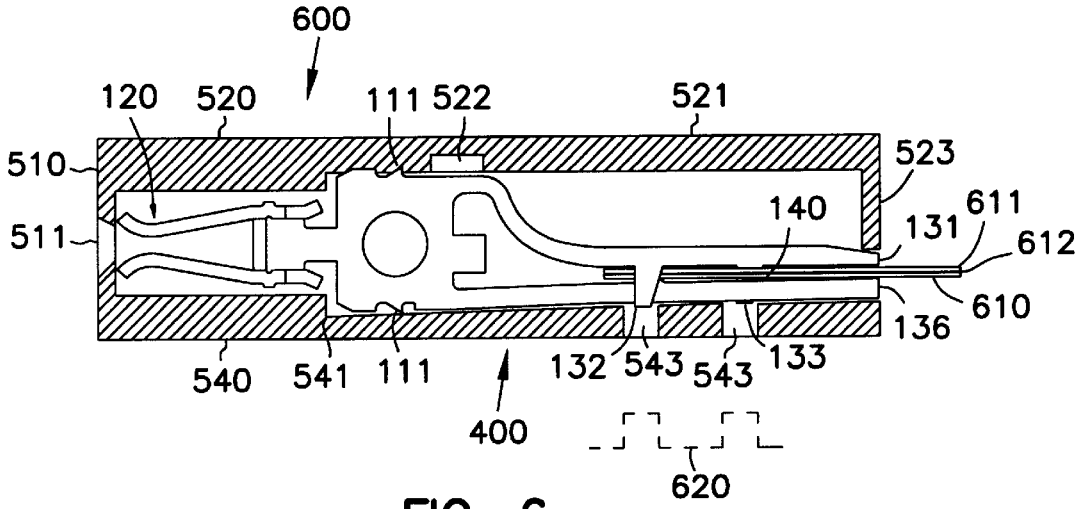
FIG. 6 shows the connector of FIG. 5 after assembly with a multiconductor cable.

FIG. 6 is a side view in cross section of a connector 600 having a stack of elements 100 inserted and compressed on a multiconductor flat cable 610. This "cable" can comprise any arrangement of small conductors lying next to each other. Typical applications include clad copper conductors spaced 0.050 inch apart within thin sheets of Mylar insulators, and a flexible circuit having conductive ink conductors spaced 0.050 or 0.039 inch within Kapton insulators, with the other side exposed. Many other conventional arrangements can also be accommodated.

Jaws receive and grip connector pins through apertures 511. Element body 120 fits snugly in a vertical position, and barbs 111 dig into upper and lower shell surfaces 520 and 540 to prevent rearward movement of the elements when the pins are inserted. The offsets 134, 135, 137, and 138 hold the element upright and prevent rotation by bearing against essentially the entire bottom of grooves 541 and against the walls between these grooves and ridges 542.

Tooling (not shown) compresses upper element leg 131 downward against cable 610. Pegs 132 and 133 slice through cable insulation 611, contact conductors 612, and exit past lower leg 136 as described above. Two interrupted slots 543 underlie each groove 541 in the region of these pegs. As a tool, hand, or other instrumentality pushes flap downward to lock tabs 524 into slots 531, a shaped anvil indicated by dashed lines 620 can be inserted into these slots to bend the sharp points of pegs 132 and 133 over the lower edge of leg 136 so as to clinch the pegs into position, as a staple folds when it strikes the anvil of a desk stapler. This provides significant additional strength to the connector, staking cable 610 firmly in place. Lower pegs 139 and 140 also pierce at least the cable insulation 611, and can also extend into contact with conductors 612 for additional electrical reliability. That is, each cable conductor 612 can have as many as four points of contact with connector element 100 along a significant distance without increasing the complexity of the element design at all.

The foregoing describes one form of connector according to the invention. Numerous modifications can be made to adapt the concept of the invention to different circumstances. For example, a single contact jaw might suffice in some applications. The jaws need not necessarily be folded out of the plane of the blank. More or fewer pegs or teeth can be employed, and their shapes can differ. The connector shells can be configured differently, and the elements can be compressed in other ways. For example, there might be advantages for some applications in locating the pegs or teeth 132, 133, 139, and 140 on the bent portions of legs 131 and 136, between the offset regions 134 and 135 of leg 131 and/or the offset regions 137 and 138 of leg 136. This angles the pegs with respect to the lengthwise direction of connector element 100, yet still allows them to be formed from a flat strip or blank and compressed in a direction parallel to the original blank.

The invention claimed is:

1. A connector element for flat cables, formed from a single piece of conductive material, comprising:

a flat vertical body having proximal and distal edges;

a jaw extending away from the proximal edge of the body portion for engaging a contact;

a pair of legs extending lengthwise from the distal edge of the body, spaced apart from each other vertically but bendable toward each other in the plane of the body;

a peg extending vertically from one of the legs toward the other leg for engaging a conductor of the cable when the legs are bent toward each other, where the peg is offset from the plane of the body, but extends substantially parallel thereto.

2. The connector element of claim 1 where the one leg includes a bow in the plane of the body.

3. A connector element integrally formed from a single flat blank of conductive material of a predetermined thickness, comprising:

a body extending in a plane of the blank and having proximal and distal edges;

at least one jaw at the proximal edge of the blank for engaging a contact pin;

a pair of legs in the plane of the blank and extending lengthwise from the distal edge of the body, the legs being spaced apart from each other in the plane of the blank but compressible toward each other, at least one of the legs being offset from the plane of the blank along at least a part of its length, and at least one of the legs carrying a peg extending toward the other leg for engaging a cable conductor when the legs are compressed toward each other.

4. The connector element of claim 3 where the peg is formed in the one leg such that the peg extends over the other leg when the legs are compressed toward each other.

5. The connector element of claim 4 where the peg is sharpened to a point away from the one leg.

6. The connector element of claim 4 where the thickness of the peg decreases away from the one leg.

7. The connector element of claim 4 where a portion of the peg extends beyond the other of the legs when the legs are compressed.

8. The connector element of claim 3 where two portions of the one leg are offset from a plane of the body.

9. The connector element of claim 8 where the two portions are offset in different directions from the plane of the body.

10. The connector element of claim 8 further comprising a second peg, each portion of the one leg carrying one of the pegs.

11. The connector element of claim 3 further comprising another peg formed in the other leg and extending toward the one leg.

12. The connector element of claim 11 where the other peg is shorter then the first peg.

13. The connector element of claim 11 where the other peg is sharpened to a point.

14. A method of forming a plurality of connector elements from a flat blank, comprising:

stamping said connector elements from the blank such that each element has a body, at least one jaw extending from a proximal edge of the body, and a pair of spaced-apart legs extending from a distal edge of the body;

bending the jaw away from the plane of the blank;

forming at least one peg in one of the legs extending in the plane of the blank toward the other of the legs;

elevating a portion of one of the legs slightly away from the plane of the blank along at least a portion of its length.

15. The method of claim 14 where the portion of the one leg is substantially parallel to another portion of the one leg.

16. The method of claim 14 further comprising elevating a portion of the other leg slightly away from the plane of the blank.

17. The method of claim 16 where the portion of the other leg is substantially parallel to another portion of the other leg.

18. The method of claim 16 where the legs are offset in opposite directions from the plane of the blank.

19. A method of forming a plurality of connector elements from a flat blank, comprising:

stamping said connector elements from the blank such that each element has a body, at least one jaw extending from a proximal edge of the body, and a pair of spaced-apart legs extending from a distal edge of the body;

bending the jaw away from a plane of the blank;

forming at least one peg in one of the legs extending in the plane of the blank toward the other of the legs;

stacking a plurality of the connector elements into a connector shell in a direction perpendicular to the plane of the blank;

compressing the legs of all the elements toward each other in the plane of the blank, so as to engage a plurality of conductors of a flat cable, wherein compressing the legs causes a tip of the peg to fold.

* * * * *

UNITED STATES PATENT AND TRADEMARK OFFICE

CERTIFICATE OF CORRECTION

PATENT NO.: 6,086,409

DATED: Jul. 11, 2000

INVENTOR(S) : Patel et al.

It is certified that error appears in the above-identified patent and that said Letters Patent is hereby corrected as shown below:

On the title page, delete "AbelConn" and insert --AbelConn--, therefor.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*